US012460424B2

(12) United States Patent
Svanströmer

(10) Patent No.: US 12,460,424 B2
(45) Date of Patent: Nov. 4, 2025

(54) WOOD BOARD FOR OUTDOOR DECKING USE

(71) Applicant: CALVEA AB, Stockaryd (SE)

(72) Inventor: Ronny Svanströmer, Stockaryd (SE)

(73) Assignee: CALVEA AB, Stockaryd (SE)

( * ) Notice: Subject to any disclaimer, the term of this patent is extended or adjusted under 35 U.S.C. 154(b) by 213 days.

(21) Appl. No.: 18/568,983

(22) PCT Filed: Jun. 22, 2022

(86) PCT No.: PCT/SE2022/050623
§ 371 (c)(1),
(2) Date: Dec. 11, 2023

(87) PCT Pub. No.: WO2022/271076
PCT Pub. Date: Dec. 29, 2022

(65) Prior Publication Data

US 2024/0287821 A1 Aug. 29, 2024

(30) Foreign Application Priority Data

Jun. 22, 2021 (SE) ..... 2150798-3

(51) Int. Cl.
*E04F 15/04* (2006.01)
*E04C 2/10* (2006.01)
(Continued)

(52) U.S. Cl.
CPC ..... *E04F 15/04* (2013.01); *E04F 15/02183* (2013.01); *E04C 2/10* (2013.01);
(Continued)

(58) Field of Classification Search
None
See application file for complete search history.

(56) References Cited

U.S. PATENT DOCUMENTS 482,536 A 9/1892 Zagelmeyer
1,018,987 A * 2/1912 Philpot ..... E04F 15/04 52/177
(Continued)

FOREIGN PATENT DOCUMENTS

JP 2016513225 A * 5/2016 ..... E04F 15/04
WO WO 9401632 A1 1/1994
(Continued)

OTHER PUBLICATIONS

International Search Report and Written Opinion dated Aug. 26, 2022, for PCT Application No. PCT/SE2022/050623.
(Continued)

*Primary Examiner* — Phi D A
(74) *Attorney, Agent, or Firm* — Joseph T. Leone; DeWitt LLP

(57) ABSTRACT

The present invention relates to a wood board (1) for outdoor decking (8) use, which board has been sawn from lumber close to bark side of the lumber, with a thickness in the range from about 10 mm up to about 32 mm, the wood board (1) comprises a first side (2) and an opposing second side (4), the first side (2) can be arranged as an upper side of the wood board (1) and the second side (4) can be arranged as a lower side of the wood board (1), or vice versa, between the first side (2) and the second side (4) the board (1) has two opposite short sides (9, 11). The wood board (1) is provided with a convex first side (2) and a convex second side (4).

14 Claims, 1 Drawing Sheet

(51) Int. Cl.
*E04F 15/02* (2006.01)
*E04C 2/32* (2006.01)

(52) U.S. Cl.
CPC ..... *E04C 2/328* (2013.01); *E04F 15/02177* (2013.01); *E04F 15/046* (2013.01)

(56) References Cited

U.S. PATENT DOCUMENTS 1,543,698 A * 6/1925 Cormie ..... E04B 2/56 52/478
1,946,646 A * 2/1934 Storm ..... E04F 15/04 52/586.1
2,038,433 A * 4/1936 Lawrence, Jr. ..... E04F 15/04 52/512
2,573,465 A * 10/1951 Lundberg ..... B27D 1/06 144/349
2,835,938 A * 5/1958 Mcelroy ..... E04B 1/6154 52/509
2,894,292 A * 7/1959 Gramelspacher ..... E04F 15/046 428/56
3,235,920 A * 2/1966 Davis ..... E04B 1/6162 411/921
3,374,703 A * 3/1968 Davis ..... E04B 1/615 411/921
3,377,758 A * 4/1968 Witschnig ..... E04B 1/10 D25/150
4,279,108 A * 7/1981 Collister, Jr. ..... E04B 2/702 52/286
4,787,185 A * 11/1988 Gascho ..... E04B 2/702 52/592.6
4,834,585 A * 5/1989 Hasenwinkle ..... E02D 29/0266 405/286
4,901,489 A * 2/1990 Garber ..... E04B 2/704 144/368
5,394,667 A * 3/1995 Nystrom ..... E01D 19/125 52/480
5,474,831 A * 12/1995 Nystrom ..... E04F 15/04 428/167
5,806,249 A * 9/1998 Helms ..... A01G 9/28 47/33
6,153,293 A 11/2000 Dahl et al.
D535,082 S * 1/2007 Adkins ..... D1/122
D819,234 S * 5/2018 Stephens ..... D25/150
10,619,412 B2 * 4/2020 Chen ..... E06B 9/386
D1,056,254 S * 12/2024 Svanströmer ..... D25/128
2003/0110727 A1 6/2003 Gregori
2004/0187411 A1 * 9/2004 Clegg ..... E04B 2/702 52/313
2005/0126109 A1 6/2005 Aldykiewicz, Jr. et al.
2005/0178071 A1 8/2005 Wood
2007/0130852 A1 * 6/2007 Sieber ..... E04B 2/702 52/233
2009/0019805 A1 1/2009 Zanelli

FOREIGN PATENT DOCUMENTS

WO WO-0171114 A1 * 9/2001 ..... E04B 2/701
WO WO-2012019227 A1 * 2/2012 ..... E04F 15/02183
WO WO-2018141902 A1 * 8/2018 ..... E04C 2/40

OTHER PUBLICATIONS

Extended European Search Report, dated Mar. 18, 2025, from European Application No. 22828871.8.

* cited by examiner

WOOD BOARD FOR OUTDOOR DECKING USE

TECHNICAL FIELD

The invention relates to a wood board for outdoor decking use.

BACKGROUND

The invention is advantageously used for constructing an exterior deck floor.

In conventional deck board construction, by professional and non-professional carpenters, the wood boards for the decking are usually provided from a lumberyard. The wood boards are prefabricated in various dimensions and has preferably been treated by a chemical preservation method, often using a pressure treatment including the copper preservative technology, that extends the durability when exposed for water.

There are various types of cuts of lumber. The preferred parts of the log that are best to use is flat sawn lumber from closer to the center of the tree, also known as the pith, where the growth rings or annual rings are smallest. Other parts of the lumber are less stable, such as the pieces towards the bark (this part of the lumber is called sapwood) that have larger growth rings. This depends among other things of the arrangement and pattern of wood fibres (wood grain) forming longer and shorter grain lines in the wood. The parts towards the bark have longer grain lines from one side of the board to the other. This results in that this part is more unstable and has the highest risk of cupping and other unpredictable forms.

The flat sawn wood board from the lumber will thus have one flat side which can be called pith side of the board and one opposite flat side which can be called the bark side of the board.

By the wording "drying" of the wood board in the description following below, is meant that the wood board is subjected to drying naturally in sunlight or shadow, as well as by any forced industrial drying treatment process for wood. The wording "moisture content" in the wood board as defined in the description following below, is meant the content of liquids in relation to solids (in percentage) in the wood board.

When the exterior deck is subjected to water and subsequent drying, the outermost layers of the wood boards may shrink resulting in cupping of the boards. The layer at the bark side of a board will often shrink more than the layer at the pith side. When the deck is constructed, the boards shall be mounted with the pith side upwards. The reason is that when the board dries, after being subjected to moisture or rain, the upper side of the boards forming the surface of the deck layer, will usually become convex. Thus, the board will then be bent upwards. Ideally the board will only be bent slightly but enough to let the water flow off the board.

On the contrary, if the wood boards are mounted with the bark side upwards, the upper side may become concave. Thus, resulting in a cupped board that will gather water and will be uneven to walk on. The board is irrevocably damaged, and its lifetime is substantially shortened resulting in environmental impact due to increased destruction of damaged wood boards over time. The environmental impact is worrying, in particular as many wood boards are treated by the chemical preservation method. Wood boards, such as boards pressured treated with the copper preservation method, should be destructed under specific environmental requirements.

However, there is a further problem with wood boards flat sawn near the bark side (sapwood) from young lumber, especially thin dimensions of wood board, such as about 30-32 mm or less. On the contrary, compared to flat sawn wood boards of older lumber from closer to the center of the tree, flat sawn near the bark side may shrink more at the pith side.

The wood boards for decking provided for sale at lumberyards are often of various quality and if you should minimize risks for cupping of the decking boards, a careful selection of the wood boards is necessary in order to choose the suitable boards for the construction.

Non-professionals that construct a decking board themselves do not usually have the knowledge to select suitable wood boards for the deck floor construction.

Further, also experts such as experienced carpenters, may have difficulties finding and choosing the desired quality of the preferred wood boards to use. This may result in time consuming and costly efforts.

There is a desire to improve the overall quality of the wood boards provided for construction of an exterior deck floor. Further, there is a desire to improve the durability of the wood boards provided for construction of an exterior deck floor.

Yet further there is a desire to improve that the wood boards are correctly installed during assembly and mounting of an exterior deck floor. Doing this may increase the lifetime of the deck floor.

A further desire is to eliminate the risk for installing the wood boards incorrectly. Doing this may result in less environmental impact due to decreased destruction of damaged wood boards since the durability and lifetime may be increased.

SUMMARY

An object of the invention is to improve the overall quality of wood boards provided for construction of an exterior deck floor. Another object of the invention is to improve the durability of the wood boards provided for construction of an exterior deck floor. A further object is to improve that the wood boards are correctly installed during assembly and mounting, resulting in less environmental impact and a longer lifetime of the exterior deck floor.

The objects are achieved by a wood board according to claim 1. Thus, the objects are reached with a wood board for outdoor decking use. The board has been sawn from lumber close to bark side of the lumber, i.e. so called sapwood, with a thickness in the range from about 10 mm up to about 32 mm. The wood board comprises a first side and an opposing second side. The first side can be arranged as an upper side of the wood board and the second side can be arranged as a lower side of the wood board, or vice versa. Between the first side and the second side the board has two opposite short sides. The first side and the second side are convex. As a result, although one of the first or the second side would be subjected to cupping, one of the sides of the board would, in almost all cases, still be provided with the desired convex shape. The risk for arranging the wood boards incorrectly during assembly and mounting of an exterior deck floor is decreased significantly. The advantage is that the lifetime of the deck board increases. Unnecessary destruction of damaged wood boards due to cupping can be avoided and the environmental impact will be reduced. Further, a major part of a wood log can be used for providing wood boards for decking use. The quality of the wood boards will be uniform to a high degree and the average quality level of the wood boards can be guaranteed. The preparation work including selecting and deciding which boards to use will be less time consuming and less costly. Thanks to the prefabricated convex profile, rapid water draining from the surface of the board is ensured.

According to an aspect of the invention, the wood board has been treated by a chemical preservation method, preferably a pressure treatment including the copper preservative technology, to a moisture content in the range from 30% up to about 35%. This has the advantage that the wood board may have a flexibility such that the board can be easily bent in the transvers direction as well as in the longitudinal direction. This result in an uncomplicated and simplified handling when the wood boards are installed during assembly and mounting of an exterior deck floor, despite the fact that the lower side also, to some degree, still can be somewhat convex when attached adjacent a support structure.

According to a further aspect, the invention also provides that a radius of curvature of the convex first side and the second side, respectively, of the wood board may be in the range from about 300 mm up to about 20000 mm. This has the advantage that the curving of the convex sides can be adapted with respect to the required properties and design of the wood boards. A larger radius in the range may be used for larger dimension of the boards, while a smaller radius is suitable for instance for wood boards having width from about 100 mm up to about 125 mm.

According to a further aspect of the invention, a radius of the corners where the convex first side and the second side, respectively, meet the short sides is in the range from about 2 mm up to about 10 mm. Thanks to the rounded edge in this range at the short sides, water draining from the surface of the board is ensured.

According to yet a further aspect of the invention the wood board has a width in the range from about 95 mm up to about 225 mm and a thickness in the range from about 10 mm up to about 32 mm, preferably from about 12 mm up to about 30 mm, and more preferred from about 14 mm up to about 28 mm. These preferred ranges of wood boards are advantageous since such dimensions within the ranges will provide a high strength deck board construction and practically manageable dimensions during assembly and mounting of a deck floor.

According to another aspect of the invention, the convex sides of the wood board are planed. By providing a wood board with planed convex sides, a smooth and even surface can be provided.

Nevertheless, in the rare case that both of the sides of the wood board would be subjected to cupping after being prepared and provided in accordance with the invention, the wood board will be discarded and not be used for decking.

Further advantages and advantageous features of the invention are disclosed in the following description and in the dependent claims.

BRIEF DESCRIPTION OF THE DRAWINGS

Below, embodiments of the invention will be described with reference to the drawings, in which.

DETAILED DESCRIPTION OF EMBODIMENTS OF THE INVENTION

Figure 1:
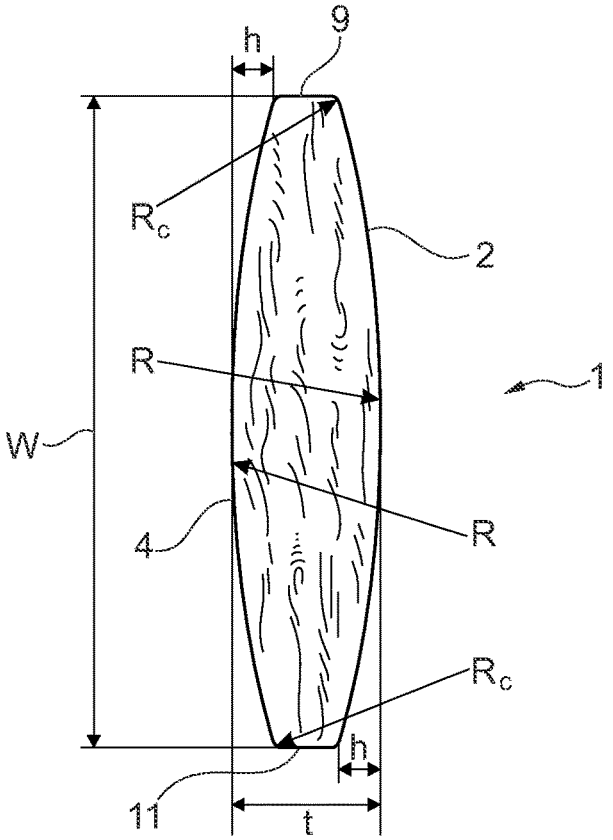
FIG. 1 shows a wood board for outdoor decking use according to an embodiment of the invention.

FIG. 1 shows a wood board 1 for outdoor decking use, from a short side view, according to an embodiment of the invention. The wood board 1 can preferably be flat sawn from parts of a log that is not close to the center of the tree, suitably wood boards flat sawn near the bark side (sapwood) from young lumber, especially thin dimensions of wood board, such as about 30-32 mm or less. Hence, with the present invention it is not only necessary to use sawn wood board for decking provided from the stable parts of the log which has been more or less a demand for the producers of wood boards.

On the contrary, the present invention preferably makes use of wood boards flat sawn near the bark side (sapwood) from young lumber, especially thin dimensions of wood board, such as about 30-32 mm or less. This is a conscious choice from an environmental point of view, despite the fact that flat sawn near the bark side may shrink more at the pith side, compared to flat sawn wood boards of older lumber from closer to the center of the tree. In this way, a major part of a wood log can be used for providing wood boards for outdoor decking use.

The wood board 1 may be treated by a chemical preservation method, using a pressure treatment including the copper preservative technology, that extends the durability when exposed for water. The prepared wood board treated by the chemical preservation method may preferably have a moisture content in the range from 30% up to about 35%.

According to the invention, the wood board 1 comprises a first side 2 and a second side 4 such that the wood board 1 is provided with a convex upper side and a convex lower side. The convex shape of the upper and lower sides of the wood board 1 is provided in a condition before being subjected to any substantial uncontrolled drying such as subjected to sunlight or other dry conditions. However, the wood board 1 may be provided with a controlled drying process as mentioned below.

Figure 2:
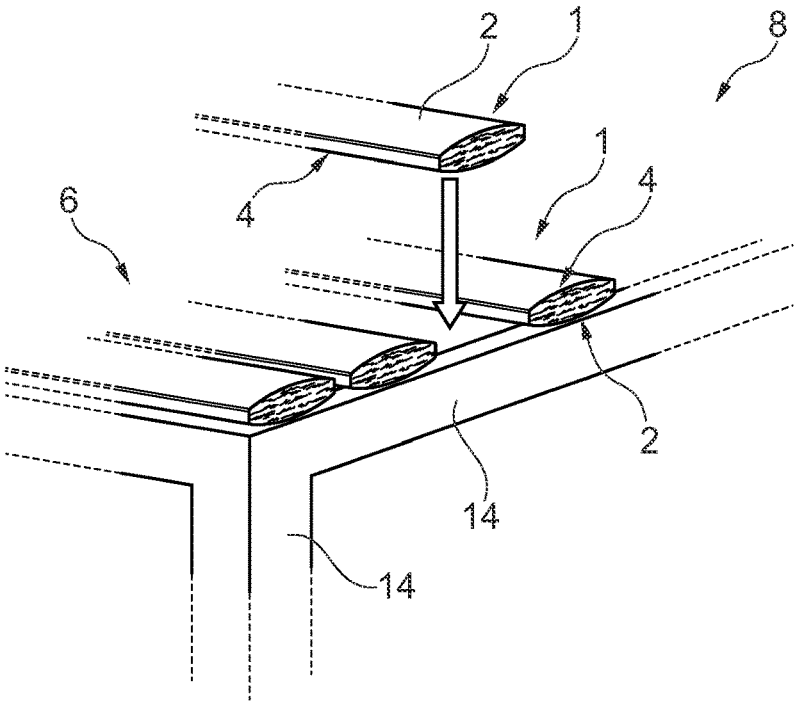
FIG. 2 shows an outdoor decking under construction with wood boards as described with reference to FIG. 1, according to yet another embodiment of the invention.

After the wood board 1 has been prepared according to the invention, it may be subjected to further drying uncontrolled, in natural way by being exposed to sunlight and also when in used in shadow or stored in during dry conditions. Drying may also be provided in a controlled way by any forced industrial drying treatment process for wood. By the wording "moisture content" in the wood board as defined in the description of the present invention, is meant the content of liquids in relation to solids (in percentage) in the wood board. Although the wood boards may be dried to a large extent in which the moisture content can be much lower than the mentioned range from 30% up to about 35%, for instance when prepared by a chemical preservation method, the wood can still be used for decking purposes. Probably one of the convex sides of the wood board 1 would then be subjected to cupping, but the other opposing side would in most cases still be convex and be arranged as an upper surface 6 of an outdoor decking 8, as shown in FIG. 2.

The first side 2 is also called a first long side, and the second side 4, opposite the first side 2, may also be called a second long side. Between the first side 2 and the second side 4 the board have two short sides, a first short side 9 and a second short side 11 opposite the first short side 9.

The first side 2 can be arranged as an upper side of the wood board while the second side 4 can be arranged as a lower side of the wood board, or vice versa.

The wood board 1 is provided with a convex upper side and a convex lower side. The first side 2 and the second side 4 of the wood board 1 is provided with a convex profile, formed by planing the flat sawn wood board 1. The convex profile of the board 1 will ensure that water does not stay on the first side 2 and the second side 4, whichever of the first or second side 2, 4 that is decided to be the arranged as an upper side of the wood board when mounted for the outdoor decking 8, which is further described below with reference to FIG. 2.

As a result, any risk for cupping of wood board 1 in which water stays on an upper concave surface instead of flowing off the upper side can be avoided. The water can be drained rapidly from the surface of the upper side of the board 1.

Further, thanks to the convex side 2, 4, the risk for arranging the wood boards 1 incorrectly during assembly and mounting of an exterior outdoor decking floor is decreased significantly. The advantage is that the lifetime of the outdoor decking board 1 is increase. Unnecessary destruction of damaged wood boards 1 due to cupping of the sides 2, 4 of the wood boards 1, that provides the floor of the decking, can be avoided and the environmental impact will be reduced.

The wood board 1 as shown in FIG. 1 may be provided in various dimensions. Suitably, the wood board 1 may have a width W in the range from about 95 mm up to about 225 mm and a thickness in the range from about 10 mm up to about 32 mm, preferably from about 12 mm up to about 30 mm, and more preferred from about 14 up to about 28 mm.

The wood board 1 as shown and described with reference to FIG. 1 may have a radius of curvature R of the convex upper side in the range from about 300 mm up to about 20000 mm. This has the advantage that the curving of the convex sides 2, 4 can be adapted with respect to the required properties and design of the wood boards 1. A larger radius R in the range may be used for larger dimension of the boards 1, for instance for wood boards 1 having width W about 175-200 mm. A smaller radius R is suitable for instance for wood boards 1 having width W about 100-125 mm. The radius Rc of the corners, where the convex sides 2, 4 meet the short sides 9, 11, may be in the range from about 2 mm up to about 10 mm.

As an example, the wood board 1 shown in FIG. 1 may have a width W of 120 mm and a thickness t of 28 mm. A height h of the convex curvature at the center of the board 1 is set to 3 mm. Then, the radius R of curvature of the convex sides 2, 4 are 610 mm. The radius of the corners Rc, where the convex sides 2, 4 meet the short sides 9,11, may be 4 mm.

FIG. 2 shows the outdoor decking 8 under construction with wood boards as described with reference to FIG. 1. The wood boards are arranged side by side and attached adjacent a support structure 14 by fasting elements, e.g. screws, against the support structure 14 underneath the boards 1. Any one of the first or second sides 2, 4 of the wood board 1, at the time for construction of the decking 8, that still has a convex side is arranged upwards as the upper side, facing away from the support structure 14. The side of the wood board 1 which may not be convex due to the fact that the wood board has being subjected to substantial drying over time, may be flat or cupped. In that case, a side 2, 4 of the wood board 1 which is not convex no longer, at the time for construction of the decking 8, is arranged downwards as the lower side adjacent the support structure 14. However, both the first side 2 and the second side 4 of the wood board 1 may still be convex after being subjected to substantial drying at the time for construction of the decking 8, and in that case any of the sides 2, 4 can be arranged as the upper or the lower side. Even if the side of the board that is still convex is arranged as the lower side adjacent the support structure 14, the board can be firmly attached by fasting elements against the support structure 14, due to the moderate radius of curvature R of the convex side as preferably provided, described in the example in the detailed description above.

It is to be understood that the present invention is not limited to the embodiments described above and illustrated in the drawings; rather, the skilled person will recognize that many changes and modifications may be made within the scope of the appended claims. Further, the drawings are not made to scale.

The invention claimed is:

1. A wood board (1) for outdoor decking (8) use comprising a board sawn from lumber close to a bark side of the lumber, with a thickness in the range from about 10 mm to about 32 mm, wherein the wood board (1) comprises a first side (2) and an opposing second side (4), the first side (2) arranged as an upper side of the wood board (1) and the second side (4) arranged as a lower side of the wood board (1), or vice versa, wherein extending between the first side (2) and the second side (4), the board (1) has two opposite short sides (9, 11), characterized in that the first side (2) and the second side (4) are convex, and wherein the wood board is dimensioned and configured to accommodate a fastening element passing through the first side (2) and the second side (4).

2. The wood board (1) according to claim 1, wherein the wood board (1) has been treated by a chemical preservation method.

3. The wood board (1) according to claim 1, wherein a radius of curvature (R) of the first side (2) and the second side (4), respectively, is in the range from about 300 mm to about 20,000 mm.

4. The wood board (1) according to claim 1, wherein a radius of corners (Rc) where the convex first side (2) and the second side (4), respectively, meet the short sides (9, 11) is in the range from about 2 mm to about 10 mm.

5. The wood board (1) according to claim 1, wherein the wood board (1) has a width (W) in the range from about 95 mm to about 225 mm and a thickness (t) in the range from about 10 mm to about 32 mm, or from about 12 mm to about 30 mm, or from about 14 to about 28 mm.

6. The wood board (1) according to claim 2, wherein the wood board (1) has been treated with a copper-containing preservative.

7. The wood board (1) according to claim 2, wherein the wood board (1) has been pressure-treated with a copper-containing preservative.

8. The wood board (1) according to claim 2, wherein the wood board (1) has a moisture content in the range from about 30% to about 35%.

9. The wood board (1) according to claim 2, wherein a radius of curvature (R) of the first side (2) and the second side (4), respectively, is in the range from about 300 mm to about 20,000 mm.

10. The wood board (1) according to claim 2, wherein a radius of corners (Rc) where the convex first side (2) and the second side (4), respectively, meet the short sides (9, 11) is in the range from about 2 mm to about 10 mm.

11. The wood board (1) according to claim 3, wherein a radius of corners (Rc) where the convex first side (2) and the second side (4), respectively, meet the short sides (9, 11) is in the range from about 2 mm to about 10 mm.

12. The wood board (1) according to claim 2, wherein the wood board (1) has a width (W) in the range from about 95 mm to about 225 mm and a thickness (t) in the range from about 10 mm to about 32 mm, or from about 12 mm to about 30 mm, or from about 14 to about 28 mm.

13. The wood board (1) according to claim 3, wherein the wood board (1) has a width (W) in the range from about 95 mm to about 225 mm and a thickness (t) in the range from about 10 mm to about 32 mm, or from about 12 mm to about 30 mm, or from about 14 to about 28 mm.

14. The wood board (1) according to claim 4, wherein the wood board (1) has a width (W) in the range from about 95 mm to about 225 mm and a thickness (t) in the range from about 10 mm to about 32 mm, or from about 12 mm to about 30 mm, or from about 14 to about 28 mm.

* * * * *